United States Patent [19]

Spurr

[11] 4,139,227

[45] Feb. 13, 1979

[54] SECURITY DOOR GUARD

[76] Inventor: Robert E. Spurr, 25001 Hendon, Laguna Hills, Calif. 92653

[21] Appl. No.: 788,413

[22] Filed: Apr. 18, 1977

[51] Int. Cl.[2] ..... E05C 17/54

[52] U.S. Cl. ..... 292/339

[58] Field of Search ..... 292/338, 339, 262, 263, 292/DIG. 15, DIG. 46

[56] References Cited

U.S. PATENT DOCUMENTS

| | | | |
|---|---|---|---|
| 467,589 | 1/1892 | Finegan | 292/338 |
| 790,653 | 5/1905 | Notthoff | 292/339 |
| 1,158,330 | 10/1915 | Stulp | 292/202 |
| 1,353,543 | 9/1920 | Schoelkopf | 292/339 |
| 1,615,357 | 1/1927 | Bruhn et al. | 292/338 |
| 1,631,980 | 6/1927 | Piccirilli | 292/338 |

*Primary Examiner*—Richard E. Moore

*Attorney, Agent, or Firm*—Lawrence D. Sassone

[57] ABSTRACT

The door guard exerts pressure against a door knob and a closed door thereby preventing the door from being opened or the door knob from being rotated. Tremendous pressure can be exerted against a door by the door guard because its upper member and lower member may pivot about each other which permits the placing of the upper end of the top member on the door knob and the lower end of the bottom member on the floor at a point closer to the door than would be possible if the guard had just one member or did not have pivotable members.

2 Claims, 7 Drawing Figures

SECURITY DOOR GUARD

BACKGROUND OF THE INVENTION

Doors have customarily been secured by locks having a latch or bolt going from the door into a doorjamb or door frame or by a sliding bolt or door chain inside. Locks inside a door knob can be easily opened by placing a pipe wrench on the door knob until the lock breaks. Dead Bolt locks have the disadvantage as do all locks of being unlocked by anyone with a duplicate or master key.

In many cases a lock, bolt, door frame or door chain are so weak that a strong blow to the door will cause them to break and the door to open. A door can also be forced open by jimmying it or by pushing the latch back with a thin flexible material or cutting the bolt.

Added security can be obtained by placing a chair against the door by inserting the top of the back of the chair under the door knob and the two back legs of the chair on the floor. However, a chair is not designed for this purpose and it fits loosely and therefore can be dislodged from its position. Also, a chair is rigid and a great deal of force must be exerted in trying to make it fit tightly against the door. Placing a chair against a door is also a nuisance in that the chair extends out into the room and is a safety hazard not to mention the loss of use of the chair for its intended purpose.

Attempts to solve the above problems have been virtually fruitless. One known apparatus is a rigid device having a V-shape at the top where the V-shape end is placed under the door knob and the other end is placed on the floor. These type of apparatus still have the disadvantage of being rigid and it is virtually impossible to force them against the door so that they will fit tightly. One can kick them or hammer on them but the result is still a loose fit which makes it easy to dislodge and virtually useless as a security device.

SUMMARY OF THE INVENTION

The present invention relates to a security device which will prevent a door from being opened by exerting substantial pressure on the door at the door handle. It is an object of the invention to provide an apparatus which will prevent a door from being opened. It is a further object of the invention to provide an apparatus that will work on virtually all doors. It is a further object of the invention to provide an apparatus that will prevent the door knob from rotating and that will force the top of a door into a bind with the top of the door frame when an attempt is made to forcibly open the door. It is a further object of the invention to provide an apparatus that is compact in size, will be a minimum intrusion into a room and that will fold substantially in half so that it may fit in a suitcase and to facilitate storage, shipping and carrying of the invention.

The present invention is a door guard having an extended length and comprises a top member having an upper end and a lower end, pivot means having a pivot axis coupled with the top member and a bottom member having a lower end and an upper end coupled to the top member by the pivot means. It is preferred that the top member be substantially straight and that the bottom member also be substantially straight. The pivot means permits the door guard to be folded substantially in half for storage or shipping purposes and also permits the top member and the bottom member to be positioned so that the door guard is fully extended to its extended length. The pivot means permits the bottom member to rotate or pivot with respect to the upper member so that the upper end of the top member may be placed on a door knob while the lower end of the bottom member is placed on the floor at a point closer to the door than would be possible if the door guard were rigid. The lower end of the bottom member may be placed an inch or more closer to the door because of the pivot means.

The door guard is initially placed against the door so that the bottom member is rotated approximately 30° from the straight in line position with respect to the top member. The door guard is then pressed into its extended length at which point the angle between the top member and the bottom member is 0.5° to 2.5°. This angle, hereinafter referred to as the extended length angle, places the top member and the bottom member just slightly out of the parallel position. The extended length angle may be measured by determining the angle between a line drawn along the length of the top member and a line drawn along the length of the bottom member.

Thus, the door guard is installed by placing the upper end of the top member at the bottom of the door knob where it meets the door with the bottom member pivoted towards the door approximately 30° from the parallel position to the top member and with the lower end of the bottom member on the floor. The pivot axis is preferred to be approximately two to six inches above the lower end of the top member. This creates a lever action when the bottom member is rotated towards the door at an angle of approximately 30° to the top member. By pressing on the lower end of the top member a great deal of force will be applied to the door by the upper end of the top member and against the floor by the lower end of the bottom member and the bottom member and the top member will be forced to pivot about the pivot axis to the zero degree or parallel position and to rotate past the parallel position to the extended length angle of approximately 0.5° to 2.5°.

The extended length angle of 0.5° to 2.5° will prevent the top member and the bottom member from rotating out of the extended length position when pressure is applied in attempting to open the door. A stop is coupled to the top member so that the bottom member may be prevented from pivoting past the extended length angle. It is preferred that the center side of the top member at the lower end of the top member function as a stop. It is preferred that the top member be channel aluminum and have a first inner side, second inner side and a center side between the first and second inner sides and that the first and second inner sides be parallel to each other and perpendicular to the center side. It is also preferred that the bottom member be channel aluminum, square wall aluminum tube or square wall steel tube having a first side and a second side that are substantially parallel to the first inner side of the top member. It is also preferred that the bottom member have an exterior width less than the interior width of the top member so that the bottom member will actually fit within the first and second inner sides of the top member. In this embodiment it is preferred that the pivot means be a pin disposed around a pin axis and that the pin axis be perpendicular to the first and second inner sides of the top member and to the first and second sides of the bottom member. The bottom member is coupled to the top member by inserting the pin through a first hole through the first inner side of the top member then through a first hole in the first side of the bottom member then through a second hole through the second side of the bottom member then through the second hole in the second inner side of the top member.

The door guard is less likely to slip off the door or door handle if a first and second finger is coupled to the upper end of the top member. When the door guard is placed under the door knob the fingers will then go on either side of the door knob.

The extended length of the door guard will depend on the height of the door knob on the door. Since most door knobs are approximately 36 inches above the floor it is preferred that the door guard have an extended length of 37 to 48 inches. The door guard is best pressed into the extended length position by hand when the top member has a length of 22 to 26 inches and the bottom member has a length of 19 to 23 inches and a pivot axis is one to 8 inches from the lower end of the top member and within one inch of the upper end of the bottom member. The door guard can be pressed into the extended length position by foot when the top member has a length of 38 to 41 inches and the bottom member has a length of 3 to 7 inches. The extended length of the door guard is adjustable by means of a threaded shaft mated to the upper end of the top member by way of a threaded bore having a bore axis along the length of the top member. The extended length of the door guard can also be made adjustable by having a plurality of adjustment holes along the length of the top member capable of receiving the pin.

DETAILED DESCRIPTION

Figure 1:
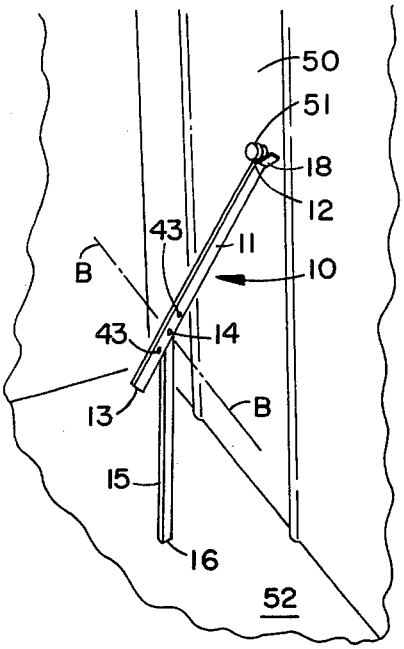
FIG. 1 is a side perspective view of the door guard positioned against a door and on the floor with an angle of approximately 30 degrees between the top member and bottom member which is the initial step for installing the door guard and is referred to as the preliminary position.

Reference is now made to the accompanying drawings for a better understanding of the invention, wherein all the parts are numbered and directions, lengths and axes are identified by letters.

A door guard (10) having an extended length (A) is indicated generally and comprises a top member (11) having an upper end (12) and a lower end (13), pivot means (14) having a pivot axis (B) coupled to the top member (11), and a bottom member (15) having a lower end (16) and an upper end (17) coupled to the top member (11) by the pivot means (14) as shown in FIGS. 1–6. The door guard (10) shown in FIGS. 1–6 illustrates a preferred embodiment of the invention wherein the door guard (10) has an extended length (A) comprising a substantially straight top member (11) having an upper end (12) and a lower end (13), a substantially straight bottom member (15) having a lower end (16) and an upper end (17) with the upper end (17) coupled to the lower end (13) of the top member (11), a pin (24) disposed around a pin axis (B) coupled to the upper end (17) of the bottom member (15) and to the top member (11) so that the bottom member (15) and the top member (11) may rotate about the pin axis (C), a stop (23) coupled to the top member (11) so that the bottom member (15) is prevented from rotating in one direction when the extended length angle (J) is 0.5° to 2.5°, a first finger (18) coupled to the upper end (12) of the top member (11), and a second finger (19) coupled to the upper end (12) of the top member.

Figure 6:
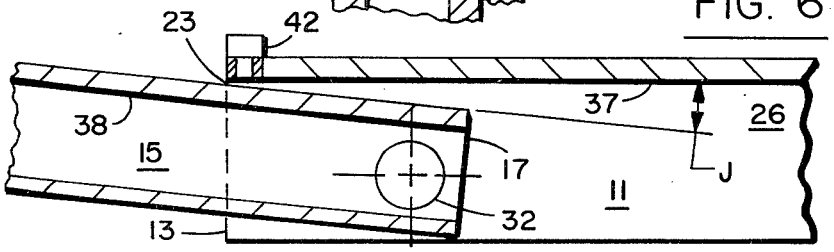
FIG. 6 is a side view of the door guard illustrating the extended length angle in a slightly exaggerated manner and showing a cross section of the door guard at approximately the middle of the center sides of the door guard.

FIG. 1 shows the door guard (10) in the preliminary position. In the preliminary position the bottom member (15) is rotated approximately 30° towards the door (50) from the parallel or straight in line position with respect to the top member (11). The straight in line or parallel position is that in which the angle (J) illustrated in FIG. 6 is zero degrees which occurs when a line drawn along the length of the top member (11) and a line drawn along the length of the bottom member (15) are parallel which is the case when the top member (11) and the bottom member (15) are both straight. In the preliminary position the upper end (12) of the top member (11) is placed at the bottom of the door knob (51) where the door knob (51) meets the door (50) and the lower end (16) of the bottom member (15) is placed on the floor (52). The pivot axis (B) is perpendicular to the length (F) of the top member and to the length (G) of the bottom member and is parallel to the surface of the door (50) when the door is closed as shown in FIG. 1.

When the door guard (10) is in the preliminary position as shown in FIG. 1 a lower end (13) of the top member (11) acts as a lever acting about the pivot axis (B). The door guard (10) is pressed into the extended length position by pressing on the lower end (13) of the top member (11) which causes the bottom member (15) and the top member (11) to pivot about the pivot axis (B) to the parallel position or straight in line position where the angle (J) is zero degrees and to rotate past the straight in line or parallel position to the extended length position and the extended length angle of approximately 0.5° to 2.5°. The extended length position is illustrated in FIGS. 2,3,4,5 and 6. It is preferred that the pivot axis (B) be approximately two to six inches above the lower end (13) of the top member (11) so that sufficient torque can be applied at the lower end (13) of the top member (11). The torque is applied by exerting force at the lower end (13) of the top member (11) in the direction of the door (50). In the preliminary position the lower end (16) of the bottom member (15) is placed an inch or more closer to the door (50) on the floor (52) than would be possible if the door guard (10) were a rigid one piece door guard. When the door guard (10) is pressed into the extended length position against the door (50) a substantial amount of force is exerted against the door (50) and against the floor (52) and much more force than would be possible if the top member (11) and bottom member (12) did not pivot with respect to each other. This is because a one piece door guard that does not pivot cannot be placed close enough to the door at the floor to exert the required amount of force against the door. Because the door guard (10) comprises pivot means (14) the door guard (10) can be placed closer to the door (50) where the lower end (16) of the bottom member (15) touches the floor (52).

An extended length angle (J) of 0.5° to 2.5° will cause the bottom member (15) to rotate against the stop (23) and not away from the stop (23) when force is applied on the door in an attempt to open the door. If the extended length angle were less than 0.5° a force against the door might cause the bottom member (15) to rotate away from the stop (23) and to collapse door guard (10). An extended length angle (J) of greater than 2.5° would cause undue force to be exerted on the stop (23) and sacrifice the strength of the door guard (10). This is so because in the preferred embodiment the center side (37) of the top member (11) acts as the stop (23) at the lower end (13) of the top member (11). In addition an extended length angle of 0.5° to 2.5° permits one to easily remove the door guard (10) by exerting a minimal force at the lower end (13) of the top member (11) in a direction away from door resulting in a snap action. The snap action results because the door guard is under a lot of pressure and once the top member (11) and the bottom member (15) are rotated to the parallel position and just past the parallel position the force will cause the door guard (10) to snap out of its extended length position. This point may be referred to as the breaking point or point of no return. However, if the extended length angle is greater than 2.5° then a substantial amount of force would have to be applied in attempting to change the door guard (10) from its extended length position back to the preliminary position so that it may be removed from the door.

Figure 5:
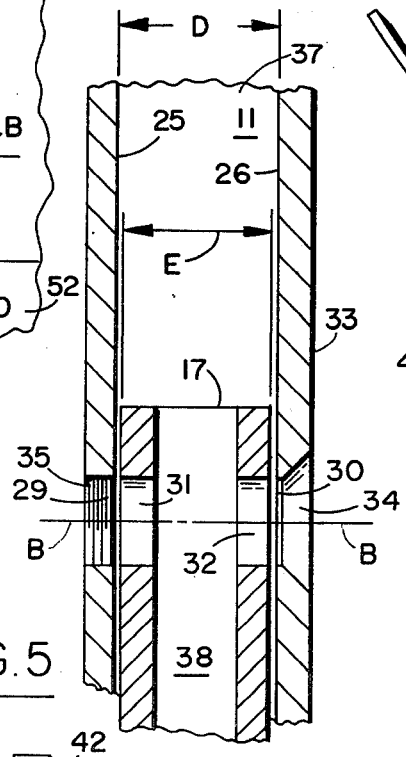
FIG. 5 is the same view as in FIG. 4 except that it is a fragmentary view at the pivot axis.
Figure 4:
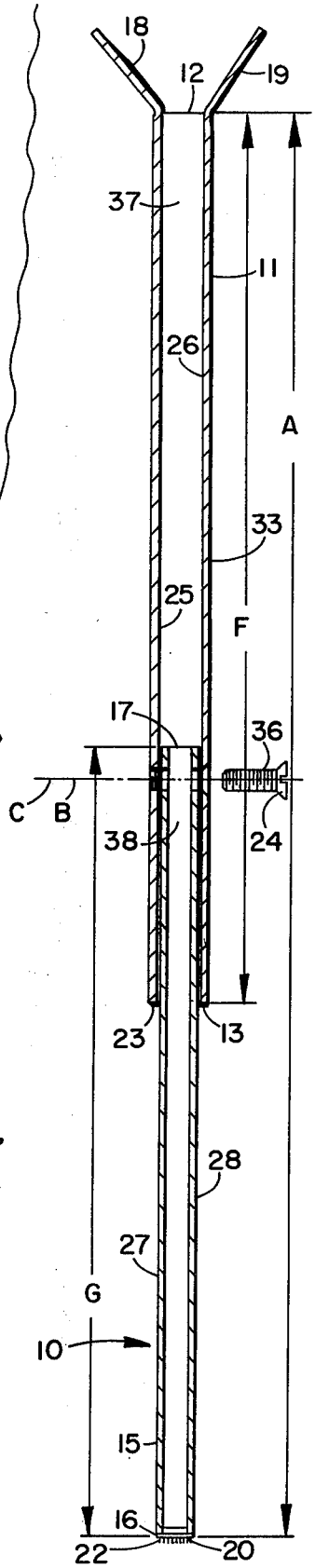
FIG. 4 is a front view of the door guard in the extended length position showing a cross section at approximately the pivot axis.

In a preferred embodiment the pivot means (14) is a pin (24) disposed around a pin axis (C) and the upper end (17) of the bottom member (15) is coupled to the pin (24) and the top member (11) so that the bottom member (15) may rotate about the pin axis (C). In one embodiment of the invention the top member (11) has a first exterior side (33) having a countersink and the pin (24) is a screw (36) that is inserted through holes (29, 30, 31, 32) in the top member (11) and bottom member (15) and that mates with a tapped hole (35) in the top member (11) as shown in FIGS. 4 and 5. The pivot means (14) may also be a screw that goes through the holes (29, 30, 31, 32) and is fastened to the door guard (10) by means of a nut, not shown, or wing nut, not shown.

In a preferred embodiment the top member (11) has a first inner side (25) and a second inner side (26) and the bottom member (15) has a first side (27) and a second side (28) and the top member (11) has a first hole (29) through the first inner side (25) of the top member (11) and a second hole (30) through the second inner side (26) of the top member (11) and the bottom member (15) has a first hole (31) through the first side (27) of the bottom member (15) and a second hole (32) through the second side (28) of the bottom member (15) and the top member (11) is coupled to the bottom member (15) by the pin (24) which is inserted in the first hole (29) and the second hole (30) of the top member (11) and through the first hole (31) and the second hole (32) of the bottom member (15) so that the first inner side (25) of the top member (11) is substantially parallel to the first side (27) of the bottom member (15) and the pin axis (C) is substantially perpendicular to the first side (27) of the bottom member (15). In this embodiment the top member (11) has a first exterior side (33) having a countersink (34) concentric with the first hole (29) of the top member (11) and the first hole (29) of the top member (11) is a tapped hole (35) and the pin (24) is a screw (36) and mates with the tapped hole (35).

In a preferred embodiment the top member (11) has a center side (37) between the first inner side (25) and a second inner side (26) of the top member (11) and the bottom member (15) has a center side (38) between the first side (27) and the second side (28) of the bottom member (15) and the exterior width (E) of the center side (38) of the bottom member (15) is less than the interior width (D) of the top member and the first inner side (25) of the top member (11) is substantially parallel to the second inner side (26) of the top member (11) and to the first side (27) and second side (28) of the bottom member (15) and a stop (23) is the center side (37) of the top member (11) at the lower end (13) of the top member (11) as shown in FIGS. 4 and 5. The interior width (D) of the top member (11) is the distance between the first inner side (25) and second inner side (26) of the top member (11). In this embodiment it is preferred that the top member have a cross section that is U-shaped and that the first inner side (25) and the second inner side (26) and center side (37) of the top member (11) all be straight, flat and have a rectangular shape. A top member (11) that is channel aluminimum is a preferred embodiment and has the preceding desired shape and geometry and is the embodiment illustrated in FIGS. 1–6. It is also a preferred embodiment that the first side (27), second side (28) and center side (38) of the bottom member (15) be straight, flat and have a rectangular shape and a U-shaped cross section or a rectangular shaped cross section or square shaped cross section. A bottom member (15) that is channel aluminum will satisfy this preference for a U-shaped cross section and a bottom member (15) that is square wall steel tube or square wall aluminum tube will satisfy the preference for a square shaped cross section. It is also preferred that the top member (11) have a plurality of adjustment holes (43) along the length (F) of the top member (11) capable of receiving the pin (24).

In a preferred embodiment a first finger (18) is coupled to the upper end (12) of the top member (11) and a second finger (19) is coupled to the upper end (12) of the top member (11). The size of the fingers (18 and 19) should be small enough so that each may fit between the door knob (51) and the door (50). The portion of the finger (18 and 19) closest to the door (50) when the door guard (10) is in the extended length position should be at an angle so that the finger will not stick into the door surface. This can be accomplished by giving the finger a triangular shape or a curved surface, not shown. Another way to prevent the finger (18 and 19) from sticking into the door would be to set the finger back towards the center side (37) of the top member (11), not shown. It is preferred that the fingers be designed so that each finger (18 and 19) and the upper end (12) of the top member (11) all contact the door (50) or door knob (51) so that the door guard (10) touches the door (50) and door knob (51) at a total of three places which will give greater stability to the door guard (10) when it is in the extended length position and a force is exerted on the door by one attempting to open the door. The first finger (18) and second finger (19) will help prevent the door guard (19) from slipping off the door (50) and door knob (51).

A stop (23) is coupled to the top member (11) so that the bottom member (15) may be prevented from pivoting or rotating. The stop (23) may be the center side (37) of the top member (11) at the lower end (13) of the top member (11) as shown in FIG. 6. The stop (23) may also be a screw (42) in the center side (37) of the top member (11) at the lower end (13) of the top member (11) as shown in FIG. 6.

Figure 2:
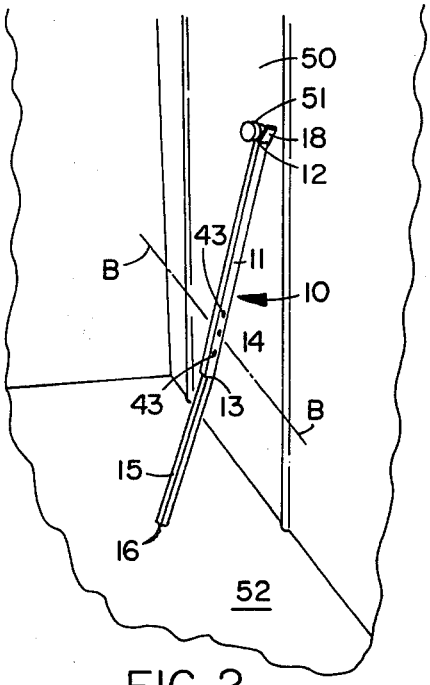
FIG. 2 is the same view as in FIG. 1 except that the door guard is in the extended length position which secures the door.
Figure 7:
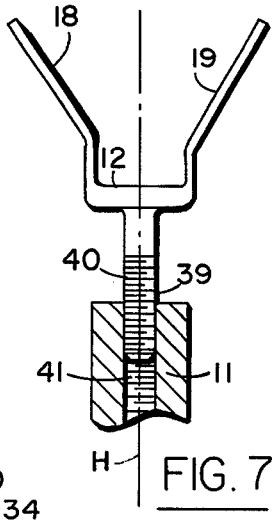
FIG. 7 is a front view of an embodiment having adjustment means comprising a threaded shaft and a threaded bore and a first finger and a second finger.

In another embodiment the door guard (10) has adjustment means (39) whereby the extended length (A) of the door guard (10) is adjustable. One embodiment of the adjustment means is shown in FIG. 7 wherein the adjustment means (39) is a threaded shaft (40) and a threaded bore (41) having a bore axis (H) along the length (F) of the top member (11) and the threaded bore (41) is coupled to the upper end (12) of the top member (11) and mates with the threaded shaft (40). The extended length (A) of the door guard (10) may be varied in an embodiment wherein the top member (11) has a plurality of adjustment holes (43) along the length (F) of the top member (11) capable of receiving the pin (24) as shown in FIG. 2. In the embodiment shown in FIG. 7 the first finger (18) and second finger (19) are coupled to the top member (11) by the threaded shaft (40).

Figure 3:
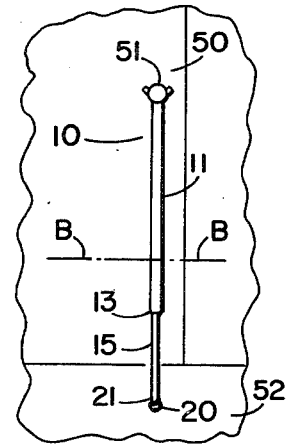
FIG. 3 is a rear view of the door guard and the extended length position which position is also shown in FIG. 2.

In another embodiment friction means (20) are coupled to the lower end (16) of the bottom member (15). The friction means (20) may be a rubber tip (21) as shown in FIG. 3 or a plurality of protrusions as shown in FIG. 4. Friction means (20) are desirable when the floor (52) is wood, tile, linoleum or some other slick surface. The friction means (20) help prevent the door guard (10) from sliding on the floor (52).

It is preferred that the door guard (10) have an extended length (A) of 37 to 48 inches and that the top member (11) have a length (F) of 22 to 26 inches and the bottom member (15) have a length (G) of 19 to 23 inches and the pivot axis (B) is 1 to 8 inches from the lower end (13) of the top member (11) and within 1 inch of the upper end (17) of the bottom member (15) as shown in FIG. 4. These dimensions will permit easy operation by hand and will produce the substantial force required to prevent the door from being opened. Where foot operation is desired the top member (11) has a length of 38 to 41 inches and the bottom member (15) has a length of 3 to 7 inches, not shown. This latter embodiment places the pivot axis (B) very close to the floor (52) and the door guard (10) can be pressed into the extended length (A) position by foot.

When the door guard (10) is in the extended length position as shown in FIG. 2 and FIG. 6 the preferred extended length angle (J) is between 1° to 2°. An extended length angle (J) of 1° to 2° is best suited to prevent the door guard from collapsing when pressure is applied in an attempt to open the door or when one attempts to remove the door guard from the door from inside a room. Since the tolerance on the extended length angle (J) is very small, angle adjustment means (42) may be coupled to the top member (11) so that the angle between the top member (11) and bottom member (15) is adjustable by the angle adjustment means (42), said angle being the extended length angle (J). In FIG. 6 a screw (42) is the angle adjustment means and the screw (42) is inserted through the center side (37) of the top member (11) and by varying the length of the screw (42) past the center side (37) of the top member (11) the extended length angle (J) may be adjusted with accuracy.

In a preferred embodiment the first inner side (25) and second inner side (26) of the top member (11) are substantially perpendicular to the center side (37) of the top member (11). Such a top member (11) can add substantially to the strength of the door guard (10) where the first inner side (25) and second inner side (26) of the top member (11) function also as a guide and brace for the bottom member (15). This results when the first side (27) and second side (28) of the bottom member (15) are substantially perpendicular to the center side (38) of the bottom member (15) and the exterior width (E) of the center side (38) of the bottom member (15) is slightly less than the interior width (D) of the center side (37) of the top member (11). This embodiment also permits the bottom member (15) to be rotated into the top member (11) so that the door guard (10) may be easily stored, shipped and even be placed in a suitcase.

When the door guard (10) is placed in the extended length position and against a door (50) as shown in FIG. 2 it exerts substantial pressure against the door (50) in directions perpendicular to the surface of the door (50) and parallel to the surface of the door (50). The perpendicular force prevents the door from being opened. The parallel force will cause the door to be forced upwards when an attempt is made to open the door thereby forcing the door against the top of the door frame and putting the door in a bind. The pressure of the door guard (10) against the door knob (51) will prevent the door knob (51) from rotating and thereby prevent a door latch from being opened. Thus even if one has a key one will not be able to open a door when the door guard is in place. It is desirable that the first finger (18), second finger (19) and upper end (12) of the top member (11) all contact the door knob to maximize the frictional force against the door knob (51) in order to keep it from rotating.

The door guard (10) may be made from plastic, wood, metal or other suitable materials or combinations thereof. It is a preferred embodiment that the top member (11) be aluminum in order to achieve the maximum strength with a minimum of weight. It is also preferred that the bottom member (15) be made from aluminum for the same reasons. Since the bottom member (15) is smaller in width than the top member (11) it is preferred that the bottom member (15) be made from square wall steel tube. The bottom member (15) may also be made from square wall aluminum tube however steel is preferred when the width (E) of the bottom member (15) is one-half inch or less. Where the width (E) of the bottom member (15) exceeds one-half inch square wall aluminum tube or channel aluminum may be satisfactory.

The first finger (18) and second finger (19) may be made in the embodiment using channel aluminum by cutting the center side (37) of the top member (11) at the upper end (12) of the top member so that the center side (37) of the top member (11) is completely removed for approximately 1.4 inch. The first inner side (25) and second inner side (26) of the top member (11) may also be cut where the center side (37) of the top member (11) is cut so as to give the first finger (18) and second finger (19) a triangular shape so that they will not point into the door when in the extended length position against the door. After the above cuts have been made the first finger (18) and second finger (19) are bent to the side of the door guard (10) as shown in FIG. 4 resulting in an angle of approximately 80° between the first finger (18) and second finger (19).

The bottom member (15) and the pivot means (14) may be coupled to the top member (11) by first drilling a hole through the first inner side (25) and second inner side (26) of the top member (11) thereby forming the first hole (29) and second hole (30) of the top member (11). The first hole (29) and second hole (30) must be positioned so that the bottom member (15) will be able to pivot and rotate at the point where the holes (29 and 30) are placed. The location of the holes (29 and 30) will determine what the adjusted length angle (J) will be. The first hole (31) and second hole (32) of the bottom member (15) are then drilled through the first side (27) and second side (28) of the bottom member (15) and are placed as close as possible to the upper end (17) of the bottom member (15) so that the upper end (17) of the bottom member (15) will be as close as possible to the pivot axis (B) without sacrificing strength and a distance of approximately 0.2 inch between the pivot axis (B) and the upper end (17) of the bottom member (15) is satisfactory. The bottom member (15) is then inserted into the top member (11) so that the first hole (29) and second hole (30) of the top member (11) are concentric with the first hole (31) and second hole (32) of the bottom member (15) and a screw (36) is then inserted through the holes (29, 30, 31, 32) and screwed into the tapped hole (35) or fastened to a nut or wing nut, not shown, as illustrated in FIG. 4. A rubber tip (21) is then inserted on the lower end (16) of the bottom member (15). A cylindrical rubber tip (21) having a diameter less than the width (E) of the center side (38) of the bottom member (15) is suitable.

It is to be understood that the invention is not limited to the exact details of construction, operation, or exact materials or embodiments shown and described, as obvious modifications and equivalents will be apparent to one skilled in the art, and the invention is therefore to be limited only by the scope of the appended claims.

I claim:

1. A door guard having an extended length, comprising:

a top member having an upper end and a lower end wherein the top member is channel aluminum;

pivot means having a pivot axis coupled to the top member; and a bottom member having a lower end and an upper end coupled to the top member by the pivot means wherein the bottom member is square wall steel tube or square wall aluminum tube.

2. A door guard having an extended length, comprising:

a top member having an upper end and a lower end;

pivot means having a pivot axis coupled to the top member;

a bottom member having a lower end and an upper end coupled to the top member by the pivot means; and angle adjustment means which are coupled to the first member so that the angle between the top member and bottom member is adjustable by the angle adjustment means, herein referred to as the extended length angle.

* * * * *